US005884557A

United States Patent [19]

Fürbass

[11] Patent Number: 5,884,557

[45] Date of Patent: Mar. 23, 1999

[54] DAMPING UNIT FOR OFFSET PRESSES

[75] Inventor: Jürgen Fürbass, Nussloch, Germany

[73] Assignee: Heidelberger Druckmaschinen Aktiengesellschaft, Heidelberg, Germany

[21] Appl. No.: 842,237

[22] Filed: Apr. 23, 1997

[30] Foreign Application Priority Data

Apr. 24, 1996 [DE] Germany ..... 196 16 328.5

[51] Int. Cl.[6] ..... B41F 7/26

[52] U.S. Cl. ..... 101/148; 101/350.4

[58] Field of Search ..... 101/350.1, 363, 101/147, 148, 207–210, 364, 350.4

[56] References Cited

U.S. PATENT DOCUMENTS

| | | | |
|---|---|---|---|
| 3,433,155 | 3/1969 | Norton | 101/148 |
| 3,688,694 | 9/1972 | Preuss et al. | 101/148 |
| 4,233,898 | 11/1980 | Dahlgren | 101/138 |
| 4,676,156 | 6/1987 | Aylor et al. | 101/148 |
| 5,191,835 | 3/1993 | Blanchard . | |
| 5,375,522 | 12/1994 | Junghans . | |

FOREIGN PATENT DOCUMENTS

| | | |
|---|---|---|
| 0462490 | 12/1991 | European Pat. Off. . |
| 2849096 | 5/1980 | Germany . |
| 2932105 | 2/1981 | Germany . |
| 9110345 | 11/1991 | Germany . |
| 2139561 | 11/1984 | United Kingdom . |

*Primary Examiner*—J. Reed Fisher
*Attorney, Agent, or Firm*—Nils H. Ljungman and Associates

[57] ABSTRACT

A damping unit for offset presses, which damping unit has a tipping roller which is immersed in a damping solution pan, a metering roller associated with the tipping roller, and a form roller which applies the damping solution to a printing plate of a plate cylinder. The rollers of the damping unit can be driven at different speeds and in different directions, whereby the drive can be controlled independently of the press speed.

17 Claims, 3 Drawing Sheets

DAMPING UNIT FOR OFFSET PRESSES

BACKGROUND OF THE INVENTION

1. Field of the Invention

The present invention relates to a damping or dampening unit for offset printing presses, the damping unit having a tipping roller which is immersed in a damping solution pan, a metering roller associated with the tipping roller, and a form roller which applies the damping solution to a printing plate of a plate cylinder. The rollers of the damping unit can be driven at different speeds and in different directions.

2. Background Information

To achieve a uniform film of damping solution with known damping units, (i.e. German Patent No. 91 10 345 U1), the respective rollers can be driven at different circumferential speeds or even in different directions so that the outer surfaces of the respective rollers may exhibit opposing directions of motion at the lines of contact. All of these measures can serve to minimize the amount of damping solution applied to prevent excess damping of the printing plate. The problem with these rollers, some of which are frictionally driven, is that the rotation of the printing plate can be transferred to the individual rollers. At higher press speeds, this can result in the application of additional driving force to slower moving rollers, making the precise metering of damping solution more difficult.

OBJECT OF THE INVENTION

Based on known damping units for offset presses, the object of the current invention is to create a roller drive which can be controlled independently of the press speed.

SUMMARY OF THE INVENTION

To realize this object, the present invention teaches that the metering roller can be driven by means of an independently controlled drive mechanism, and that the metering roller can be driven via an irreversible or self-locking gear. By means of the drive for the metering roller and the irreversible gear, the amount of damping or dampening solution applied can be independently controlled without the speed of the press and the friction of the respective rollers affecting the desired speed of the metering roller. Here it is assumed that ink is applied to the surface of various rollers in the damping unit, which ink increases the undesired drive power if the friction factor of the ink is high.

An advantageous embodiment of the invention is characterized by the fact that the drive mechanism can be realized as a controllable gear and that this gear can be driven by the press drive. Such a gear is normally a reducing gear so that the metering roller can be driven at a slower circumferential speed relative to the press speed.

Another advantageous embodiment of the invention is characterized by the fact that the drive mechanism can be realized as a variable-speed electric motor, and that the driving journal of the electric motor is equipped with a worm and the stub axle of the metering roller is equipped with a worm gear. The worm and worm gear can be inexpensively manufactured irreversible gears so that a precise circumferential speed can be established via the electric motor without frictional forces affecting the circumferential speed of the dosing roller.

It is also advantageous that the tipping roller be connected via a gear to the metering roller so that the amount of damping solution to be applied can also be precisely controlled via the tipping roller.

An economical solution is characterized by the fact that the gear between the tipping and metering rollers can be realized as a spur gear. With the present invention, it is also possible that the metering roller can have an outer surface made of an elastic material. If, for example, hard rubber is used, the ink film applied using the inking roller can be more evenly spread using the metering roller covered with hard rubber, which can prevent ghost images.

BRIEF DESCRIPTION OF THE DRAWINGS

The invention is shown schematically in the attached drawings, in which.

DESCRIPTION OF THE PREFERRED EMBODIMENT

Figure 1:
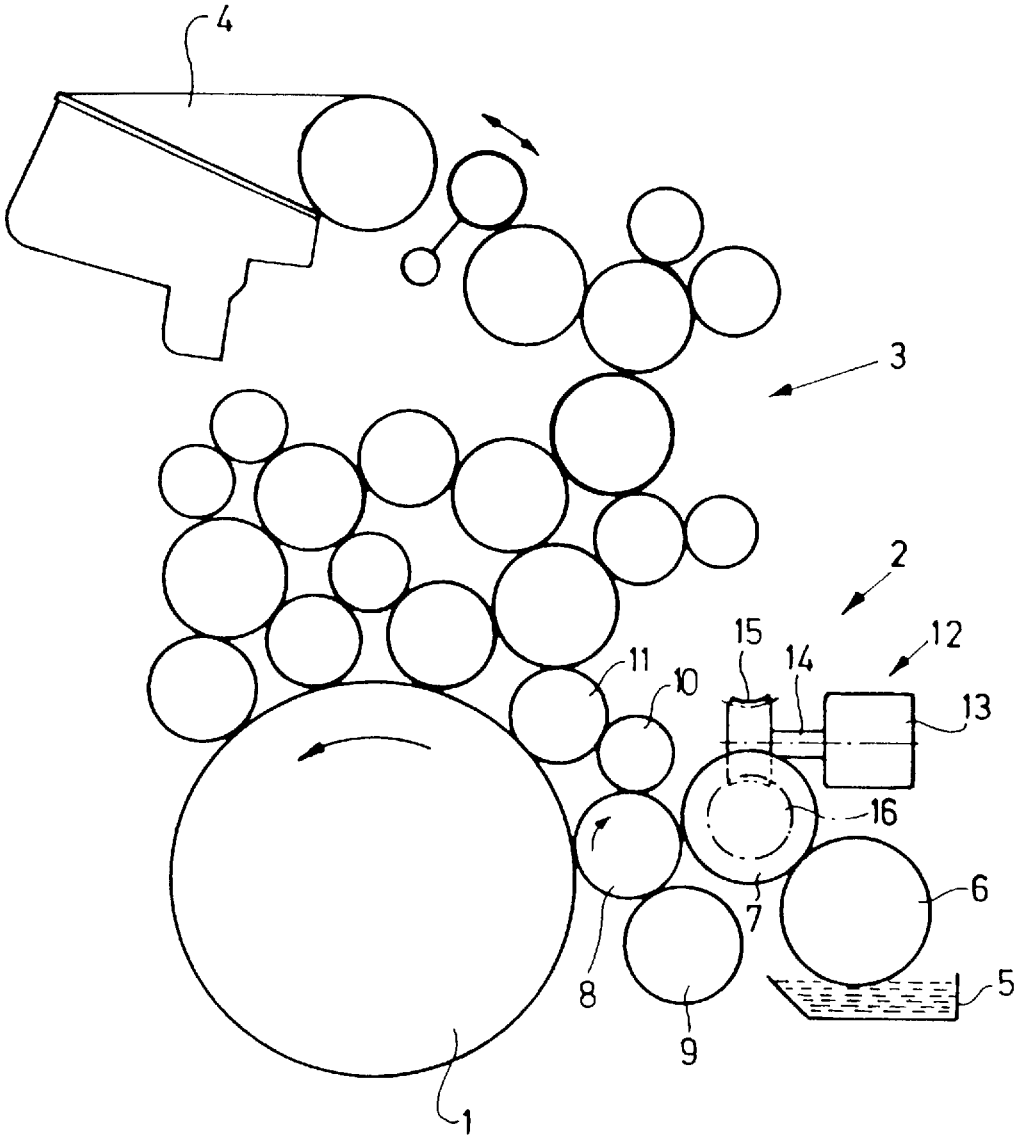
FIG. 1 shows the rollers of an inking/damping unit.

As shown in FIG. 1, a plate cylinder 1 can be associated with a damping unit 2 and an inking unit 3, whereby the inking unit 3 transfers the extracted ink via a plurality of rollers to a printing plate fastened to the plate cylinder 1. In the embodiment shown, the damping unit 2 has a damping solution pan 5 having damping solution disposed therein, in which damping solution a tipping roller 6 is immersed. A tipping roller 6 transfers damping solution to a metering roller 7, which squeezes excess damping solution onto the tipping roller 6 at their line of contact. The film of damping solution on the metering roller 7 can then be transferred to a form roller 8, which can transfer the damping solution to the printing plate on the plate cylinder 1, thus dampening or wetting the plate. The form roller 8 can be associated with a distributing roller 9, for example, and there can also be a bridge or transfer roller 10 to which ink can be applied from the form roller 8, or from a first ink form roller 11.

Figure 2:
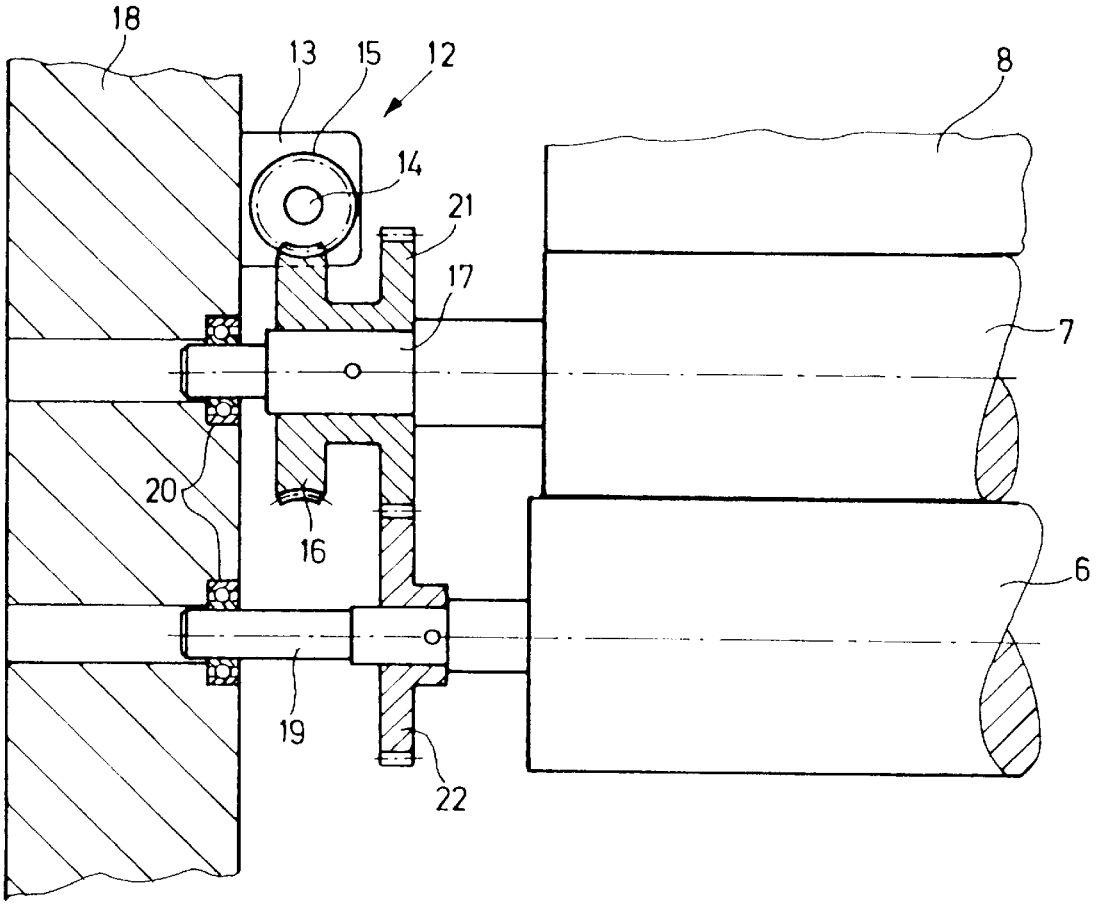
FIG. 2 shows a longitudinal section through a drive, the metering roller and the tipping roller.

According to the present invention, the metering roller 7 can be associated with a drive mechanism 12 which drives the metering roller 7 via an irreversible gear. In the embodiment shown, the drive mechanism comprises an electric motor 13, connected to a driving journal 14 to which driving journal 14 a worm 15 is fastened. The worm 15 meshes with a worm gear 16 fastened to a stub axle 17 (see FIG. 2) of the metering roller 7. The electric motor 13 can be fastened to one side of the press frame 18. Both the stub axle 17 of the metering roller 7 and a stub axle 19 of the tipping roller 6 can be rotatably mounted in bearings 20 in a press frame 18. In an advantageous embodiment, the tipping roller 6 can be coupled to the metering roller 7 via a gear, whereby it is advantageous if the gear between the two rollers are meshing spur gears 21, 22. The two spur gears 21, 22 are fastened to the stub axles 17, 19 of the metering roller 7 and tipping roller 6, respectively. In an advantageous embodiment, the outer surface of the metering roller 7 can be made of an elastic material, such as hard rubber, to achieve a more uniform ink film and to work in the dampening solution. In such an embodiment, frictional forces can be prevented from resulting in undesired changes in the speed of the metering roller 7.

The printing press can also contain an ink duct or supply 4, which ink duct 4 can supply ink to the distributor rollers of the printing press.

Figure 3:
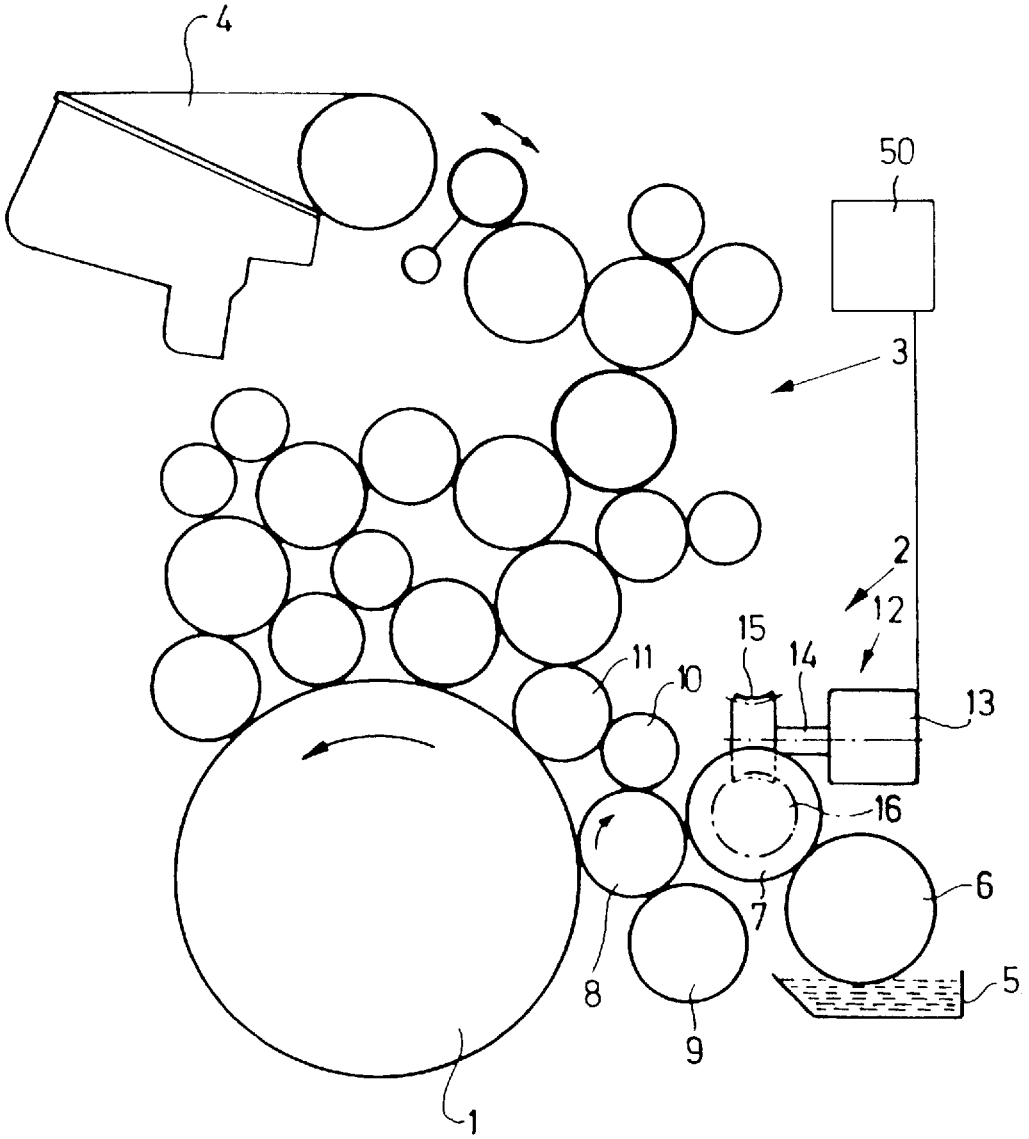
FIG. 3 shows additional detail of FIG. 1.

FIG. 3 also schematically illustrates a control system 50 for the electric motor 13. The control system 50 can operate in a number of ways to control the speed of the metering roller 7. The control unit 50 can include a computerized control system, which adjusts the speed of the motor 50 with respect to the speed of the printing press. The control unit 50 can also be in the form of a manually operated control system, featuring a "look-up" table showing the relationship between the ratio of the revolutions of the metering roller to the revolutions of the press, to the revolutions of the press itself. Other control systems can also be advantageously used with the electric motor 13.

In one advantageous embodiment of the present invention, the drive 12 can be configured to drive the metering roller 7 in the same direction as the adjoining form roller 8. If the metering roller 7 is driven in the same direction of rotation as the adjoining form roller 8, the angular velocity of the metering roller 7 can be adjusted so that it can be either greater than or less than the angular velocity of the form roller 8. Similarly, the angular velocity of the metering roller 8 can be varied with respect to the angular velocity of the plate cylinder 1 or the tipping roller 6.

In another advantageous embodiment, the metering roller 7 can be driven in the opposite direction of rotation as the adjoining form roller 8. If the metering roller 7 is driven in the opposite direction of rotation as the adjoining form roller 8, the angular velocity of the metering roller 7 can be adjusted so that it can be either greater than or less than the angular velocity of the form roller 8. Similarly, the angular velocity of the metering roller 8 can be varied with respect to the angular velocity of the plate cylinder 1 or the tipping roller 6.

In other advantageous embodiments of the present invention, the drive system could alternatively be connected to either the tipping roller 6 or the form roller 8 (not shown in the figures). In some embodiments it may even be possible to add an additional roller, which additional roller could be driven by the drive mechanism 12 to act on thee metering roller 7, tipping roller 6 and/or the form roller 8.

One feature of the invention resides broadly in the damping unit for offset presses having a tipping roller which tipping roller is immersed in a damping solution pan, a metering roller associated with the tipping roller, and a form roller which applies the damping solution to a printing plate of a plate cylinder, whereby the rollers of the damping unit can be driven at different speeds and in different directions, characterized by the fact that the metering roller 7 can be driven by an independently controllable drive mechanism and that the metering roller is driven via an irreversible gear.

Another feature of the invention resides broadly in the damping unit characterized by the fact that the drive mechanism is realized as a controllable gear and that this gear can be driven by the press drive.

Yet another feature of the invention resides broadly in the damping unit characterized by the fact that the drive mechanism 12 is realized as a variable speed electric motor 13 and that a worm 15 is fastened to the driving journal 14 of the electric motor 13 and a worm gear 16 is fastened to the stub axle 17 of the metering roller 7.

Still another feature of the invention resides broadly in the damping unit characterized by the fact that the tipping roller 6 is coupled to the metering roller 7 via a gear.

A further feature of the invention resides broadly in the damping unit characterized by the fact that the gears between the tipping roller 6 and metering roller 7 are realized as spur gears 21, 22.

Another feature of the invention resides broadly in the damping unit characterized by the fact that the metering roller 7 has an outer surface of an elastic material.

All, or substantially all, of the components and methods of the various embodiments may be used with at least one embodiment or all of the embodiments, if more than one embodiment is described herein.

All of the patents, patent applications and publications recited herein are hereby incorporated by reference as if set forth in their entirety herein.

The corresponding foreign patent publication applications, namely, Federal Republic of Germany Patent Application No. 196 16 328.5, filed on Apr. 24, 1996, having inventor Jürgen Fürbass, and DE-OS 196 16 328.5 and DE-PS 196 16 328.5 are hereby incorporated by reference as if set forth in their entirety herein.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. A damping unit for an offset printing press comprising an inking unit, a plurality of rollers, and a plate cylinder to receive a printing plate, said damping unit comprising:

a reservoir to store damping medium;

a tipping roller to transfer damping medium from said reservoir;

said tipping roller being disposed to be immersed in damping medium disposed in said reservoir;

a metering roller to transfer damping medium from said tipping roller;

a form roller;

said metering roller being disposed adjacent said tipping roller and said form roller;

said form roller being configured and disposed to apply damping medium from said metering roller to a printing plate of a plate cylinder;

an electric motor;

a worm gear arrangement;

said worm gear arrangement comprising:

a worm; and a worm gear;

said electric motor comprising a motor shaft attached directly to and driven by said electric motor;

said worm being disposed on said motor shaft;

said metering roller comprising a roller shaft attached directly to and driving said metering roller;

said metering roller being rotatable about said roller shaft;

said worm gear being disposed on said roller shaft of said metering roller;

said worm gear and said worm being directly in mesh with one another;

said worm gear arrangement being configured to be driven by said worm to provide a self-locking gear assembly to provide a speed of the metering roller controlled by the worm gear arrangement without the speed of the printing press and the friction of the rollers in contact with the metering roller affecting the desired speed of the metering roller; and the combination of said electric motor and said worm gear arrangement being configured and disposed to operate said metering roller at a rotational velocity or direction of rotation independent of the rotational velocity or direction of rotation of the printing press.

2. The damping unit according to claim 1, comprising:

a gear system; and said gear system being disposed to engage said tipping roller and said metering roller.

3. The damping unit according to claim 2 wherein said gear system to engage said tipping roller and said metering roller comprises a plurality of spur gears.

4. The damping unit according to claim 3 wherein:

said metering roller has an outer surface, said outer surface being disposed about said metering roller; and said outer surface of said metering roller comprises an elastic material.

5. A damping unit for an offset printing press comprising an inking unit, a plurality of rollers, and a plate cylinder to receive a printing plate, said damping unit comprising:

a reservoir to store damping medium;

a tipping roller to transfer damping medium from said reservoir;

said tipping roller being disposed to be immersed in damping medium disposed in said reservoir;

a metering roller to transfer damping medium from said tipping roller;

a form roller;

said metering roller being disposed adjacent said tipping roller and said form roller;

said form roller being configured and disposed to apply damping medium from said metering roller to a printing plate of a plate cylinder;

an electric motor;

a worm gear arrangement;

said worm gear arrangement comprising:

a worm; and a worm gear; and said worm being operatively connected to said electric motor;

said worm gear being operatively connected to said metering roller;

said worm gear arrangement being configured to be driven by said worm to provide a self-locking gear assembly to provide a speed of the metering roller being controlled by the worm gear arrangement without the speed of the printing press and the friction of the rollers in contact with the metering roller affecting the desired speed of the metering roller.

6. The damping unit according to claim 5 wherein the combination of said electric motor and said worm gear arrangement being configured and disposed to operate said metering roller at a rotational velocity or direction of rotation independent of the rotational velocity or direction of rotation of the printing press.

7. The damping unit according to claim 6 wherein:

said electric motor comprises a motor shaft attached directly to and driven by said electric motor;

said worm is disposed on said motor shaft;

said metering roller comprises a roller shaft attached directly to and driving said metering roller;

said metering roller is rotatable about said roller shaft; and said worm gear is disposed on said roller shaft of said metering roller.

8. The damping unit according to claim 7 wherein said worm gear and said worm are directly in mesh with one another.

9. The damping unit according to claim 8 comprising:

a gear system; and said gear system being disposed to engage said tipping roller and said metering roller.

10. The damping unit according to claim 9 wherein said gear system to engage said tipping roller and said metering roller comprises a plurality of spur gears.

11. The damping unit according to claim 10 wherein:

said metering roller has an outer surface, said outer surface being disposed about said metering roller; and said outer surface of said metering roller comprises an elastic material.

12. A damping unit for an offset printing press comprising an inking unit, a plurality of rollers, and a plate cylinder to receive a printing plate, said damping unit comprising:

a reservoir to store damping medium;

a tipping roller to transfer damping medium from said reservoir;

said tipping roller being disposed to be immersed in damping medium disposed in said reservoir;

a metering roller to transfer damping medium from said tipping roller;

a form roller;

said metering roller being disposed adjacent said tipping roller and said form roller;

said form roller being configured and disposed to apply damping medium from said metering roller to a printing plate of a plate cylinder;

an electric motor;

a worm gear arrangement;

said worm gear arrangement comprising:

a worm; and a worm gear;

said electric motor comprising a motor shaft attached directly to and driven by said electric motor;

said worm being disposed on said motor shaft;

said metering roller comprising a roller shaft attached directly to and driving said metering roller;

said metering roller being rotatable about said roller shaft;

said worm gear being disposed on said roller shaft of said metering roller; and said worm gear and said worm being directly in mesh with one another.

13. The damping unit according to claim 12, comprising:

a gear system; and said gear system being disposed to engage said tipping roller and said metering roller.

14. The damping unit according to claim 13 wherein said gear system to engage said tipping roller and said metering roller comprises a plurality of spur gears.

15. The damping unit according to claim 14 wherein:

said metering roller has an outer surface, said outer surface being disposed about said metering roller; and said outer surface of said metering roller comprises an elastic material.

16. The damping unit according to claim 15 wherein said worm gear arrangement is configured to be driven by said worm to provide a self-locking gear assembly to provide a speed of the metering roller controlled by the worm gear arrangement without the speed of the printing press and the friction of the rollers in contact with the metering roller affecting the desired speed of the metering roller.

17. The damping unit according to claim 16 wherein the combination of said electric motor and said worm gear arrangement being configured and disposed to operate said metering roller at a rotational velocity or direction of rotation independent of the rotational velocity or direction of rotation of the printing press.

* * * * *